US009844307B2

(12) United States Patent
Muir

(10) Patent No.: US 9,844,307 B2
(45) Date of Patent: Dec. 19, 2017

(54) CLEANING HEAD

(71) Applicant: BLACK & DECKER INC., New Britain, CT (US)

(72) Inventor: Derek Muir, Durham (GB)

(73) Assignee: BLACK & DECKER INC., New Britain, CT (US)

( * ) Notice: Subject to any disclaimer, the term of this patent is extended or adjusted under 35 U.S.C. 154(b) by 0 days.

(21) Appl. No.: 15/362,961

(22) Filed: Nov. 29, 2016

(65) Prior Publication Data

US 2017/0150859 A1 Jun. 1, 2017

(30) Foreign Application Priority Data

Nov. 30, 2015 (EP) ..... 15197125

(51) Int. Cl.
*A47L 9/04* (2006.01)
*A47L 9/06* (2006.01)

(52) U.S. Cl.
CPC ..... *A47L 9/0673* (2013.01); *A47L 9/04* (2013.01); *A47L 9/0405* (2013.01); *A47L 9/0411* (2013.01); *A47L 9/0427* (2013.01); *A47L 9/0433* (2013.01); *A47L 9/0444* (2013.01); *A47L 9/0455* (2013.01); *A47L 9/0477* (2013.01)

(58) Field of Classification Search
CPC ..... A47L 9/04; A47L 9/0405; A47L 9/0411; A47L 9/0427; A47L 9/0433; A47L 9/0455; A47L 9/0673; A47L 9/0477
USPC ..... 15/383, 389
See application file for complete search history.

(56) References Cited

U.S. PATENT DOCUMENTS 5,435,038 A 7/1995 Sauers

FOREIGN PATENT DOCUMENTS

| | | |
|---|---|---|
| DE | 522387 | 4/1931 |
| DE | 7307875 | 8/1973 |
| DE | 7442106 | 12/1974 |
| DE | 770882 | 3/1977 |
| DE | 2921874 | 12/1979 |
| DE | 10296649 | 4/2004 |
| DE | 102007031371 | 1/2009 |
| DE | 202008002071 | 7/2009 |
| DE | 102011116419 | 4/2013 |
| EP | 0351224 | 1/1990 |
| EP | 0265407 | 7/1991 |
| EP | 0739599 | 10/1996 |

(Continued)

OTHER PUBLICATIONS

EP Search Report dated Jun. 10, 2016, for Application No. 15197125.6.

(Continued)

*Primary Examiner* — David Redding
(74) *Attorney, Agent, or Firm* — John Yun

(57) ABSTRACT

A cleaning head connectable to a vacuum cleaner comprises a cassette removeably mountable on the cleaning head. A rotatable bar has projecting cleaning elements engageable with a surface to be cleaned and the rotatable bar is removeably mountable in the cassette. A first cassette mounting assembly is coupled to the rotatable bar at a first end with a first spindle. A second cassette mounting assembly is coupled to the rotatable bar at a second end with a second spindle. The first and second cassette mounting assemblies have removable cover portions for shielding the first and second spindles from debris and the first cassette mounting assembly is rotatably coupled to and removable with the first spindle.

15 Claims, 7 Drawing Sheets

(56) References Cited

FOREIGN PATENT DOCUMENTS

| | | |
|---|---|---|
| EP | 1352603 | 10/2003 |
| EP | 2659817 | 11/2013 |
| EP | 2659818 | 11/2013 |
| WO | WO2008111288 | 3/2008 |
| WO | WO2011103198 | 2/2011 |
| WO | WO2011158596 | 5/2011 |
| WO | WO2014027182 | 2/2014 |
| WO | WO2014027186 | 2/2014 |
| WO | 2014080181 | 5/2014 |
| WO | 2014111692 | 7/2014 |
| WO | WO2014195670 | 12/2014 |

OTHER PUBLICATIONS

EP Search Report dated Jun. 1, 2016 for EP Application No. 15197125.6.

CLEANING HEAD

FIELD OF INVENTION

The present invention relates to a cleaning head for a vacuum cleaner. In particular the present invention relates to a cleaning head for an upright or stickvac type vacuum cleaner.

BACKGROUND OF INVENTION

Vacuum cleaning devices are known to comprise motorised cleaning brushes. The motorised cleaning brushes or beater bars are mounted in the cleaning head of a vacuum cleaner in or adjacent to the suction nozzle. The cleaning brushes are configured to rotate within the cleaning head and engage against a surface to be cleaned. Accordingly debris is physically moved and entrained in the inward airflow into the suction nozzle. The cleaning brushes can dislodge ingrained dirt in a textile such as a carpet. This means that the suction power required to clean particularly dirty surfaces may be less. This is particularly useful for cordless vacuum cleaners when energy efficiency can increase battery life.

Some cleaning brushes, for example as shown in EP 0 351 224, can clog because debris such as hair can wrap around the cleaning brush rather than being sucked into the vacuum cleaner. According the cleaning head must be examined and the cleaning brush extracted from the cleaning head. This can be a particular nuisance because the user may have to remove large quantities of hair which is unsightly and unhygienic. Furthermore the user may have to invert the cleaning head and/or the vacuum cleaner to remove the cleaning brush which can cause debris partially sucked in to the cleaning head to fall out.

Embodiments of the present invention aim to address the aforementioned problems.

BRIEF SUMMARY OF THE INVENTION

According to an aspect of the present invention there is a cleaning head connectable to a vacuum cleaner comprising: a cassette removeably mountable on the cleaning head; a rotatable bar having projecting cleaning elements engageable with a surface to be cleaned and the rotatable bar is removeably mountable in the cassette; a first cassette mounting assembly coupled to the rotatable bar at a first end with a first spindle; a second cassette mounting assembly coupled to the rotatable bar at a second end with a second spindle; wherein the first and second cassette mounting assemblies have removable cover portions for shielding the first and second spindles from debris and the first cassette mounting assembly is rotatably coupled to and removable with the first spindle.

By providing a cassette containing the cleaning brush, the cleaning head is easier to maintain. Furthermore since the bar comprises a cover portion at each end and the first cassette mounting assembly is removable together with the first spindle, the user can easily access the bearing. This means that when hair eventually ingresses adjacent to the bearing, the user can easily dismantle the cleaning head without misplacing parts of the mounting assembly.

Preferably the first and second cassette mounting assemblies each comprise a bearing rotatably coupled respectively to the first and second spindles. Preferably the covers are respectively integral with the first cassette mounting assembly and the second cassette mounting assembly. This means that the mounting assemblies can be single removable assemblies which cannot be disassembled further by the user. This makes maintenance more straight forward.

Preferably the rotatable bar comprises a fixed flange portion at each end. This means that fibrous material that wraps around the bar is limited in its movement along the bar towards the ends. The projecting flange means that the hair must move up over the flange before being able to ingress the vicinity of the bearing.

Preferably the first spindle comprises at least one drive surface. Preferably the drive face is a D-shaped cross section. Preferably the at least one drive surface is engageable with a reciprocal surface in the rotatable bar. This means that the first spindle comprises a flat drive surface which corresponds to the flat side of the "D". This means that the first spindle does not slip with respect to the bar 222.

Preferably the second spindle is fixed to the bar and the cover is rotatably mounted on the second spindle.

Preferably the first or second cassette mounting assemblies comprises a drive gear mounted on the first or second spindle. Preferably the drive gear comprises a plurality of circumferentially spaced drive elements. Preferably each drive element comprises a camming surface and a drive surface. This means that the drive gear will always seat correctly when the cassette is inserted into the cleaning head.

Preferably the first cassette mounting assembly comprises a mounting groove for receiving reciprocal mounting ribs on the cassette. Preferably the second cassette mounting assembly comprises a mounting plug for engaging a reciprocal mounting hole in the cassette. This means that the bar is easy for the user to insert and mount in the cassette. Since the first and second cassette mounting assemblies are different, the bar has directionality and the user is not able to insert the bar the wrong way round.

Preferably the cover portions comprises an overlapping lip extending over the ends of the rotatable bar. This means that there is a labyrinthine pathway that debris must take in order to jam the bearing.

Preferably the cassette is transparent. This means that the use knows when the bar is in operation and when the cassette needs to be removed for maintenance.

Preferably the cleaning head comprises a locking mechanism for releasably locking the cassette in the cleaning head. Preferably the cassette is configured to be upwardly releasable from the cleaning head away from a surface to be cleaned. This means that the cassette is easily removable from the cleaning head without dislodging dirt from other parts of the vacuum cleaner.

BRIEF DESCRIPTION OF THE INVENTION

Various other aspects and further embodiments are also described in the following detailed description and in the attached claims with reference to the accompanying drawings, in which:

DETAILED DESCRIPTION OF THE INVENTION

Figure 1:
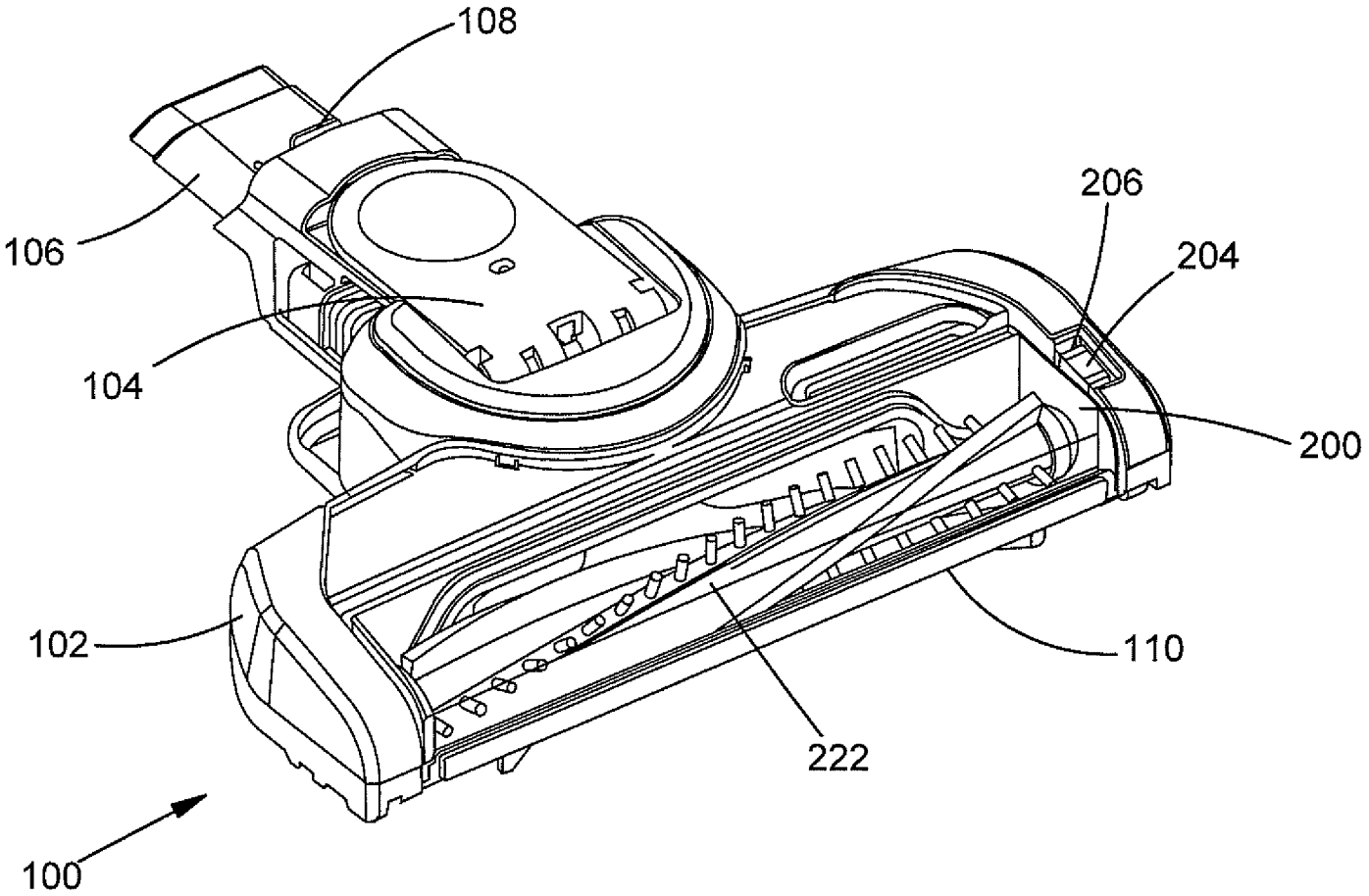
FIG. 1 shows a perspective view of a cleaning head of a vacuum cleaner.

FIG. 1 shows a perspective view of a cleaning head 100 for a vacuum cleaner (not shown). The cleaning head comprises a base portion 102 on which an articulated joint 104 is mounted. The articulated joint 104 couples the base portion 102 to a neck portion 106. The base portion 102 is arranged to move over a surface to be cleaned such as a floor. The neck 106 comprises an attachment mechanism 108 for attaching to a hose (not shown) or extension tube (not shown) of the vacuum cleaner. The cleaning head 100 is connectable to a handheld vacuum cleaner via an extension tube, a canister vacuum cleaner via a hose or directly to an upright or a stickvac vacuum cleaner. The neck 106 comprises an airway which is in fluid communication with a dirty inlet port 110 in the base portion 102. The neck portion 106 may comprise electrical power and control wires for powering and controlling functionality in the cleaning head 100. The vacuum cleaner can comprise one or more control buttons (not shown) for actuating a motor to drive the bar 222.

The articulated joint 104 provides at least two degrees of freedom of the base portion 102 with respect to the neck portion 106. The articulated joint 104 as shown in FIG. 1 comprises two pivot axes which are mounted perpendicular to each other. The articulated joint 104 is known and will not be discussed in any further detail.

The cleaning head 100 comprises a cleaning assembly or cassette 200. The cassette 200 is removeably mountable in the base portion 102. The cassette 200 is optionally transparent. This means that the user can see when the cassette 200 is in operation and when the cassette 200 requires maintenance.

Figure 2:
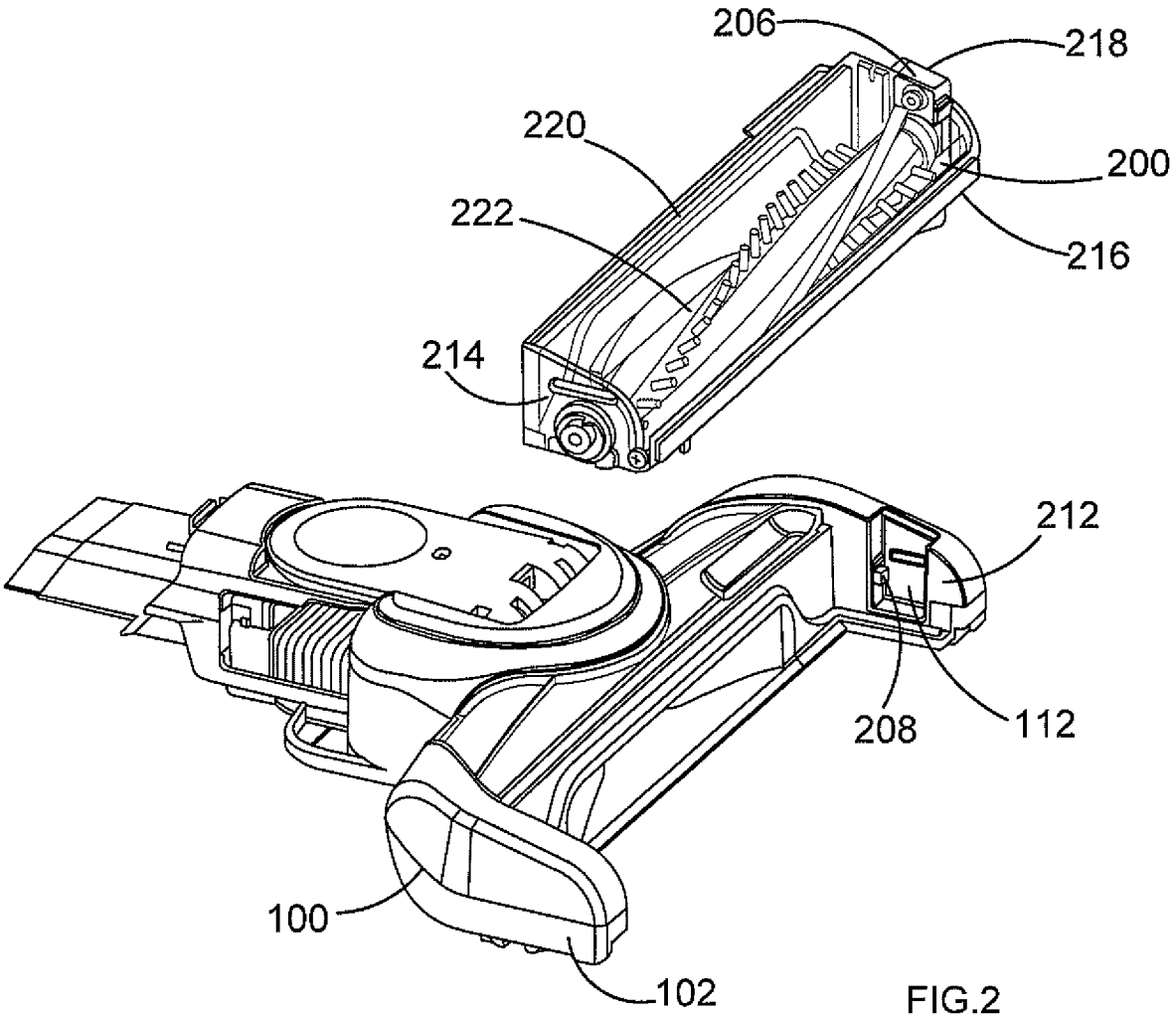
FIG. 2 shows an exploded perspective view of a cleaning head.

The cassette 200 will be discussed in further detail with reference to FIG. 2, which shows a perspective exploded view of the cleaning head 100. The cassette 200 and cleaning head 100 comprise a locking mechanism 204 for selectively releasing the cassette 200 from the cleaning head 100. The locking mechanism 204 comprises a latch 210 (see FIG. 3) and catch 208 arrangement. The cassette 200 comprises a spring biased latch 210 which is coupled to a manually operated release button 206. The base portion 102 comprises a catch 208 engageable with the latch 210 on the cassette 200. In some other embodiments the spring biased latch and the manually operated release button can be mounted on the base portion 102 and the catch element is mounted on the cassette 200. Alternatively the spring biased latch can be mounted on the cassette 200 and the release button is mounted on the base 102. In other embodiments any suitable locking mechanism can be provided for selectively releasing the cassette 200 from the cleaning head 100.

The cassette 200 is removable from the cleaning head 100 when the release button 206 is depressed. The cassette 200 is upwardly removable from the base portion 102. This means that when removing the cassette 200 from the base portion 102, the user lifts the cassette 200 away from the surface to be cleaned (such as the floor). This makes removing the cassette 200 from the base portion 102 easier for the user. Furthermore by allowing the user to vertically lift the cassette 200 from the cleaning head 100, the user does not need to tip the cleaning head 100 or the vacuum cleaner to access the cassette 200. This means that accessing and maintaining the cassette 200 is cleaner and less likely to dislodge debris which may be between the dirty air inlet and the dirt container (not shown) in the vacuum cleaner.

Figure 6:
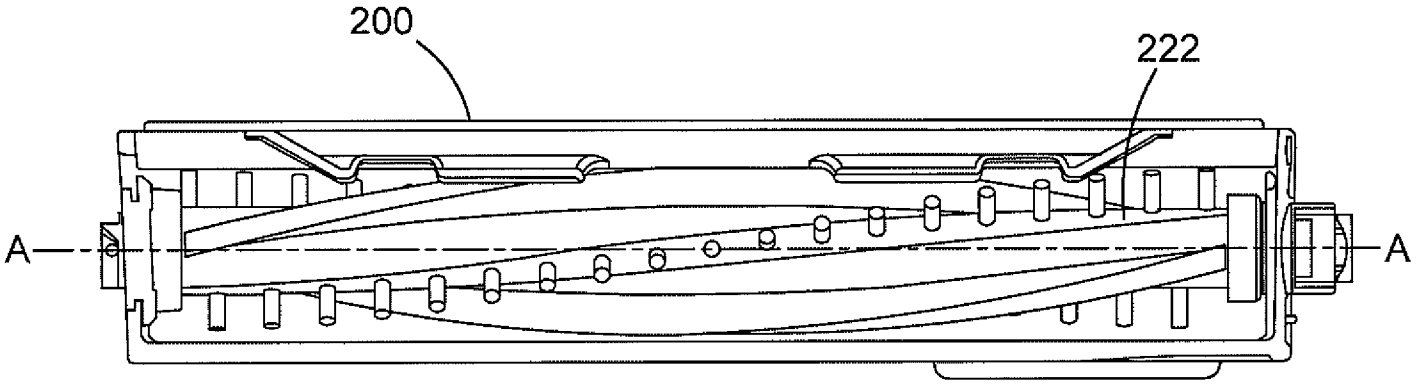
FIG. 6 shows an underneath plan view of the cassette.

The cassette 200 is generally linear in construction and extends along a longitudinal axis A-A (as shown in FIG. 6). Turning back to FIG. 2, the cassette 200 comprises a first end 214 and a second end 216. The second end 216 comprises a side rib 218 which projects outwardly from the cassette 200. The side rib 218 is configured to slide in a reciprocal vertical slot 112. The vertical slot 112 constrains the movement of the side rib 218 causing the cassette 200 to be moveable in an upwards direction.

Figure 3:
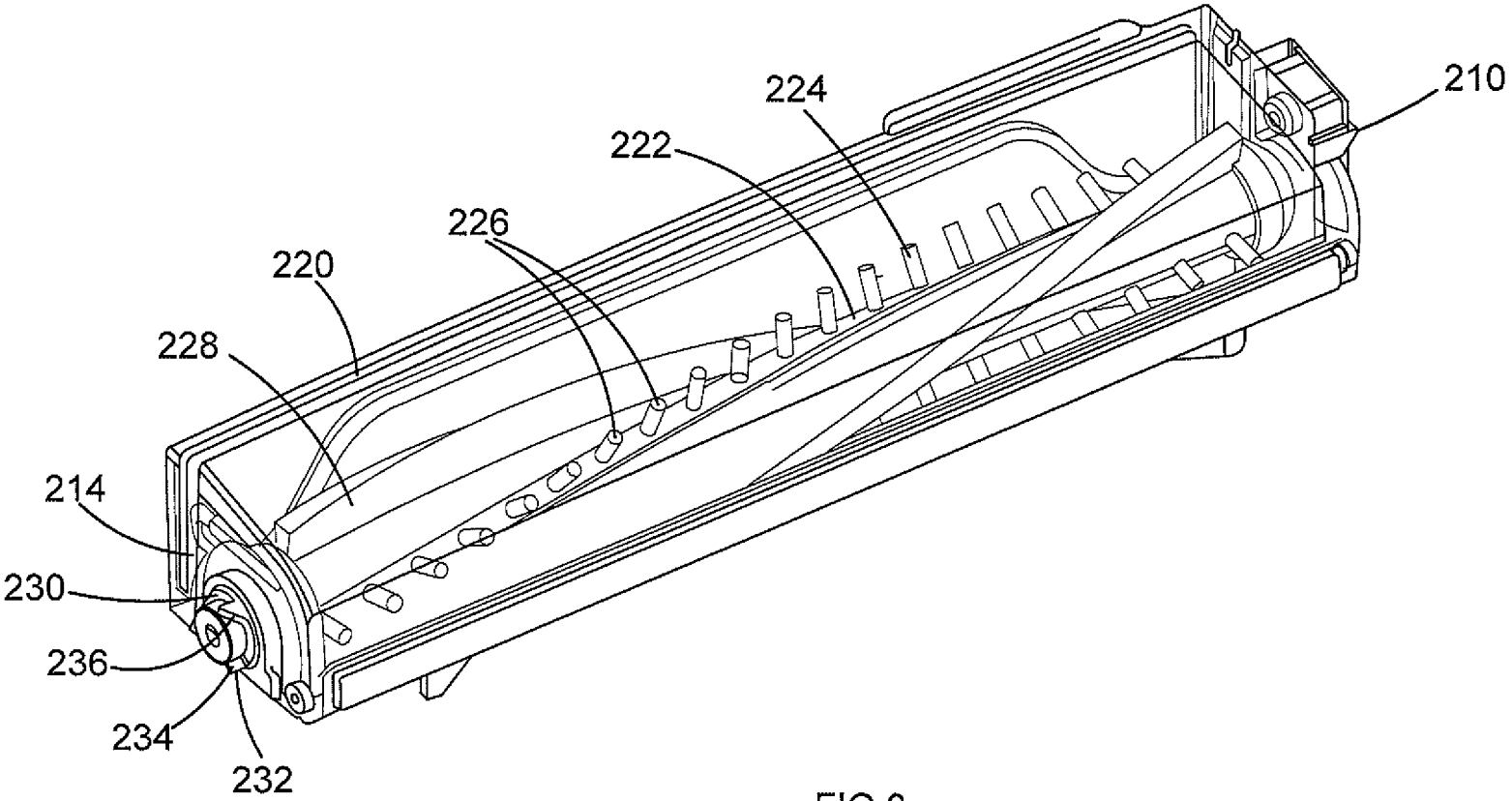
FIG. 3 shows a perspective view of the cassette.

Turning to FIG. 3, the cassette 200 will be discussed in further detail. FIG. 3 shows a perspective view of the cassette 200. The cassette 200 comprises a housing 220 and a bar 222 is mounted within the housing 220. In some embodiments the bar 222 is a cylindrical element. In other embodiments the bar 222 is elongate and substantially cylindrical and comprises ridges and groves. For example the bar 222 can comprise spiral grooves and/or ridges for receiving cleaning brushes or ribs. The bar comprises at least one cleaning element 224. The at least one cleaning element 224 can be a cleaning brush having a plurality of projecting bristle cleaning elements 226. Additionally or alternatively the bar 222 comprises any means suitable for cleaning a surface. For example the cleaning element 222 can be a strip of bristles 228, projecting rubber strip or projecting rubber fingers or a combination of different types of cleaning elements. In some embodiments the cleaning elements 226, 228 can comprise bristles having different stiffness. A variable stiffness in the bristles 226, 228 means that different types of debris can be picked up by the cassette 200.

The bar 222 is rotatably mounted in the cassette 200 such that the bar 222 is configured to rotate with respect to the cassette 200. The first end 214 of the cassette 200 comprises a drive gear 230. The drive gear 230 is configured to mesh with a motor drive gear (not shown) mounted in the base portion 102 when the cassette 200 is seated in the cleaning head 100. The motor drive gear is an inverse reciprocal shape to the drive gear 230. The drive gear 230 is configured to transmit rotational movement from a brush motor in the cleaning head 100 to the bar 222. The brush motor can be selectively operated by the user or controlled automatically. The control and operation of the brush motor is known as will not be discussed in any further detail.

The drive gear 230 comprises a plurality of circumferentially spaced drive elements 232. FIG. 3 shows three drive elements 232 equally spaced around the drive gear 230. Each drive element comprises a straight sided drive face 234 and a sloping camming face 236. In this way each drive element 232 has a saw-tooth profile. The straight sided drive face 234 comprises a flat straight sided face which is configured to engage with an identical straight sided drive face on the motor drive gear. The sloping camming face 236 is configured to engage with an identical reciprocal sloping camming face on the motor drive gear. This means that when the drive gear 230 is inserted against the motor drive gear, the drive elements 232 will either be located between drive elements on the motor drive gear or the sloping camming face 236 will engage the drive elements of the motor drive gear. If the sloping camming face 236 engages a reciprocal drive element on the motor drive gear, the sloped sided face will cam against the motor drive gear. Since the motor will not be operational when the cassette 200 is inserted into the cleaning head 100, the motor drive gear will be relatively stiff to turn. Accordingly the drive gear 230 will rotate and turn the bar 222 as the sloped sided face 236 cams against the drive elements on the motor drive gear. This means that the drive gear and the motor drive gear will always seat correctly when the cassette 200 is inserted into the cleaning head.

Figure 4:
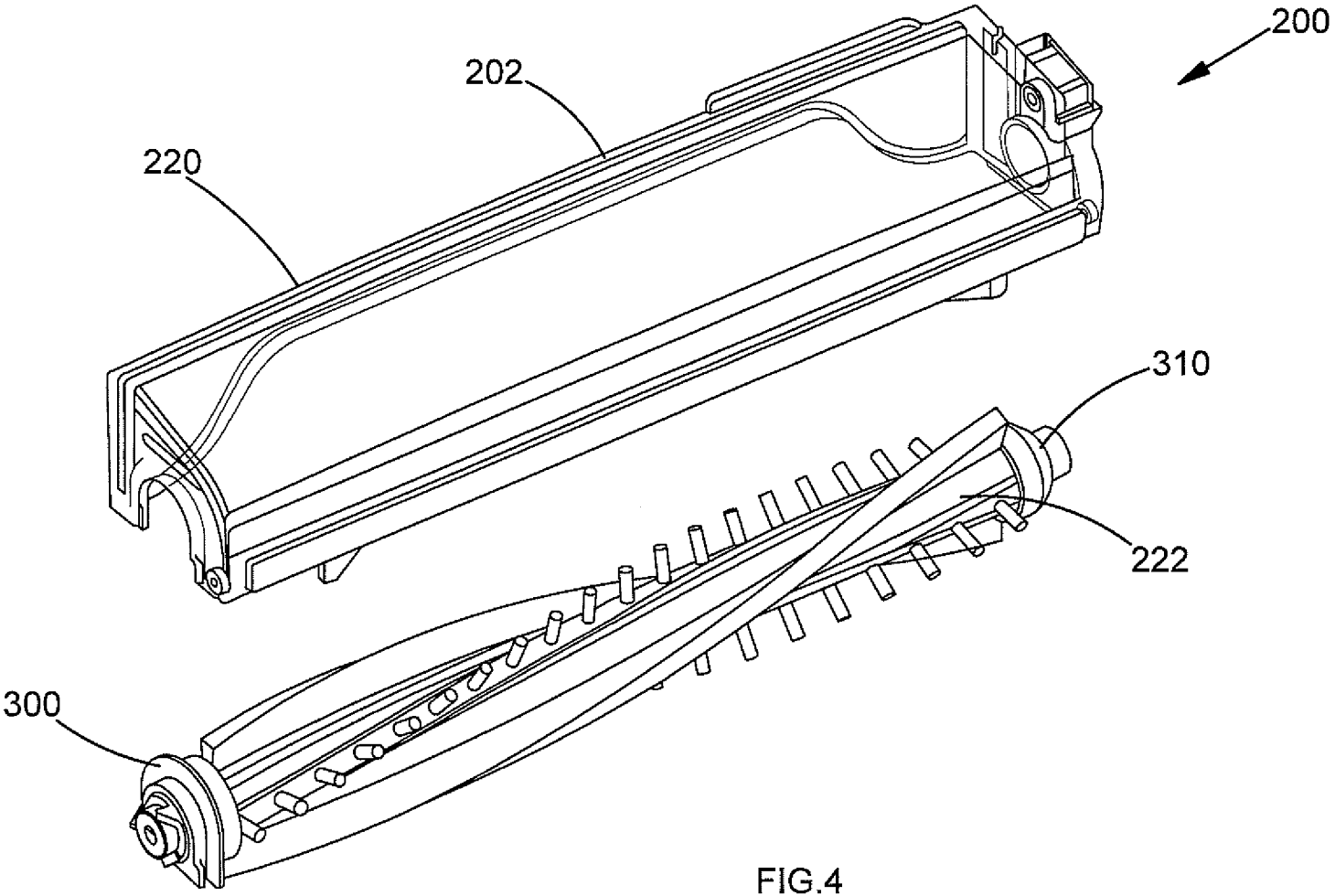
FIG. 4 shows an exploded perspective view of the cassette.

FIG. 4 shows an exploded perspective view of the cassette 200. The bar 222 is removable from the cassette 200 and can be manually disassembled by the user. FIG. 4 shows the bar 222 removed from the cassette 200. By removing the bar 222 from the cassette 200, the user is able to clean the bar 222 and the cassette housing 220. For example the user is able to more easily remove hair or other fibrous material that may have wrapped around the bar 222. The bar 222 comprises a first cassette mounting assembly 300 and a second cassette mounting assembly 310 for rotatably mounting the bar 222 in the cassette 200.

Figure 5:
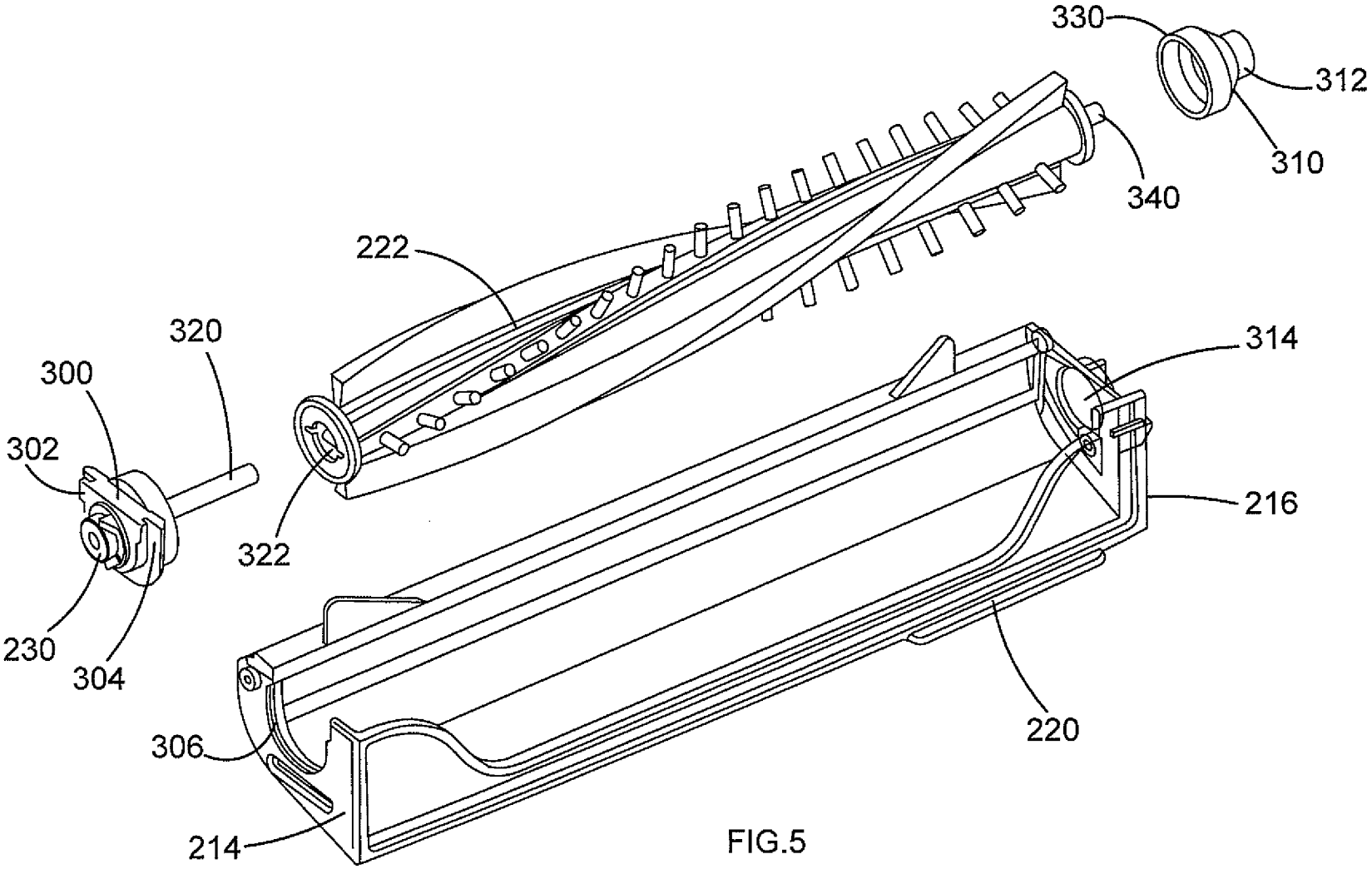
FIG. 5 shows an underneath exploded perspective view of the cassette.

The bar 222 and the first and second cassette mounting assemblies 300, 310 will be discussed in more detail with respect to FIG. 5. FIG. 5 shows an exploded perspective view of the cassette 200. The first cassette mounting assembly 300 comprises at least one mounting portion 302 for engaging with the cassette 200. The at least one mounting portion 302 comprises first and second projecting ribs 302, 304. The mounting ribs 302, 304 are configured to slot in a reciprocal groove 306 at the first end 214 of the cassette 200. The groove 306 is arranged in a plane which is perpendicular to the longitudinal axis A-A of the cassette 200. In this way the first mounting assembly 300 is configured to slide vertically or perpendicularly away from the longitudinal axis A-A cassette 200 as shown in FIG. 5.

The second cassette mounting assembly 310 comprises an end plug 312 for engaging in a reciprocal hole 314 in the second end 216 of the cassette. The end plug 312 has a push fit or interference fit with the hole 314. When removing the bar 222, the user slides the first cassette mounting assembly 300 out of the groove 306 in the cassette 200 and then pulls the end plug 312 out of the hole 314. In order to set the bar 222 in the cassette 200, the user reverses the steps for removing the bar 222 from the cassette 200. In alternatively embodiments, the first and second mounting assembles 300, 310 can comprises any suitable mechanism for mounting the bar 222 to the cassette 200. For example, the mounting assemblies 300, 310 can both have rib-groove mounting arrangements. Alternatively the mounting assemblies 300, 310 can have a snap-fit arrangement whereby the mounting assemblies are held in place with resilient retaining elements (not shown).

The first cassette mounting assembly 300 comprises a removable first spindle 320. The drive gear 230 is mounted on the removable drive spindle 320. In this way when the drive gear 230 turns, so does the first removable spindle 320. The removable first spindle 320 comprises at least one drive surface engageable with a reciprocal surface in a hole 322 in the bar 222. In some embodiments the at least one drive surface is the flat side of a D-shaped cross section. The removable first spindle 320 comprises a D-shaped cross section and fits into a reciprocal D-shaped hole 322 in the centre of the bar 222. The D-shaped cross section ensures that there is positive engagement between the removable spindle 320 and the bar 222 and the drive force from the drive gear is transmitted to the bar 222 without slipping. The flat side 516 of the D-shape of the first spindle can be seen in FIG. 7. In other embodiments the spindle 320 and the hole 322 can be any shape to prevent relative movement therebetween. For example, the cross-sectional shape can be star shaped, triangular, or square or any other suitable shape. The removable first spindle 320 is rotatably coupled to the mounting ribs 302, 304. The first cassette mounting assembly 300 comprises a bearing 500 (see FIG. 7) for permitting relative rotation of the first spindle 320 with respect to the mounting ribs 302, 304 and the cover portion 400. In this way the first cassette mounting assembly 300 and the removable first spindle 320 are a single removable assembly. This means that when the user removes the first cassette mounting assembly 300 from the bar, the removable first spindle 320 is also removed. The first cassette mounting assembly 300 is not arranged to be disassemble into separate parts. This means the user is less likely to lose parts of the cassette 200 during maintenance. Otherwise the user would have to reassemble the first spindle 320, drive gear 230, the mounting ribs 302, 304 and a plurality of washers and clips (not shown) in the right order, which would be difficult and time consuming.

The removable first spindle 320 can be rotatably mounted on the first cassette mounting assembly with C-clips. Alternatively other fastening means can be used to keep the components of the first cassette mounting assembly 300 together but allow relative rotational movement between components of the first cassette mounting assembly 300.

By permitting the user to remove the first cassette mounting assembly 300 from the bar 222, the user is able to remove any hair or other fibrous material that may have ingressed into the vicinity of the bearing 500 at the first end 214 of the bar 222. Although it may be unlikely that hair may clog the bearing 500, some hair may eventually wrap around the removable first spindle 320 and jam the bearing at the first end 214 of the bar 222. In this case by allowing the cassette 200 to be disassembled, the user can more easily maintain the cassette 200.

The second cassette mounting assembly 310 comprises a removable end cap 330. The removable end cap is rotatably mountable on a fixed second spindle 340. The fixed second spindle 340 is fixed with respect to the bar 222 such that when the bar 222 rotates, so does the fixed second spindle 340. The end cap 330 comprises a bearing 510 at the second end 216 of the cassette. This means that the fixed second spindle 340 rotates within the bearing 510 in the end cap 330. The end cap 330 is removable and this means that the user can take off the end cap 330 can expose the fixed second spindle 340. This means that the user can remove any hair or other fibrous material that may have wound around the fixed second spindle 340.

Figure 7:
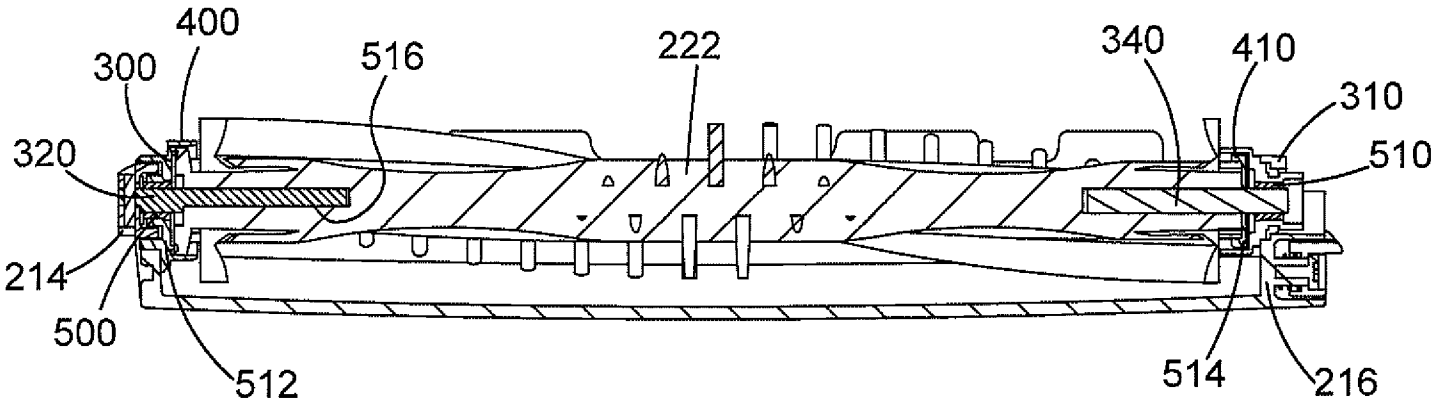
FIG. 7 shows a cross sectional side view of the cassette along axis A-A.

The cassette 200 will now be discussed in further detail with reference to FIGS. 6 and 7. FIG. 6 shows an underneath plan view of the cassette 200. FIG. 6 shows the longitudinal axis A-A of the cassette 200. The longitudinal axis of the cassette 200 is also the rotational axis of the bar 222. FIG. 7 shows a side cross sectional view of the cassette 200 along the axis A-A.

The first and second cassette mounting assemblies 300, 310 respectively comprise a first and second cover portion 400, 410. The cover portions 400, 410 respectively overlap the first and second ends 214, 216 of the bar 222. The first cover portion 400 overlaps past a first flange 512 at the first end 214 of the bar 222. Likewise the second cover portion 410 overlaps past a second flange 514 at the second end 216 of the bar 222. The flanges 512, 514 project above the surface of the bar 222. This means that any fibrous material must move up over the flange 512, 514 before it can interfere with the first and second spindles 320, 330. In some embodiments the flanges 512, 514 are permanently fixed to the bar 222 so that hair will not slip off the end of the bar 222.

The diameter of the first and second cover portions 400, 410 are slightly bigger than the diameter of the flanges 512, 514 of the bar 222. This means that the bar 222 can freely rotate with respect to the first and second cover portions 400, 410. The first cover portion 400 is integral with the with first cassette mounting assembly 300. The second cover portion 410 is integral with the second cassette mounting portion 410. In this way the cover portions 400, 410 together with the flanges 512, 514 provide a labyrinthine pathway that debris and fibrous material must take before it is adjacent to the bearings 500, 510 of the first and second ends 214, 216. This means that hair and other fibrous material is less likely to wrap around the removable first spindle 320 or the fixed second spindle 330.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A cleaning head connectable to a vacuum cleaner comprising:

a cassette removeably mountable on the cleaning head;

a rotatable bar having projecting cleaning elements engageable with a surface to be cleaned and the rotatable bar is removeably mountable in the cassette;

a first cassette mounting assembly coupled to the rotatable bar at a first end with a first spindle;

a second cassette mounting assembly coupled to the rotatable bar at a second end with a second spindle; and wherein the first and second cassette mounting assemblies have removable cover portions for shielding the first and second spindles from debris and the first cassette mounting assembly is rotatably coupled to and removable with the first spindle.

2. The cleaning head according to claim 1 wherein the first and second cassette mounting assemblies each comprise a bearing rotatably coupled respectively to the first and second spindles.

3. The cleaning head according to claim 1 wherein the covers are respectively integral with the first cassette mounting assembly and the second cassette mounting assembly.

4. The cleaning head according to claim 1 wherein the rotatable bar comprises a fixed flange portion at each end.

5. The cleaning head according to claim 1 wherein the first spindle comprises at least one drive surface engageable with a reciprocal surface in the rotatable bar.

6. The cleaning head according to claim 5 wherein the second spindle is fixed to the bar and the cover is rotatably mounted on the second spindle.

7. The cleaning head according to claim 1 wherein the first or second cassette mounting assemblies comprises a drive gear mounted on the first or second spindle.

8. The cleaning head according to claim 7 wherein the drive gear comprises a plurality of circumferentially spaced drive elements.

9. The cleaning head according to claim 8 wherein each drive element comprises a camming surface and a drive surface.

10. The cleaning head according to claim 1 wherein the first cassette mounting assembly comprises a mounting groove for receiving reciprocal mounting ribs on the cassette.

11. The cleaning head according to claim 10 wherein the second cassette mounting assembly comprises a mounting plug for engaging a reciprocal mounting hole in the cassette.

12. The cleaning head according to claim 1 wherein the cover portions comprises an overlapping lip extending over the ends of the rotatable bar.

13. The cleaning head according to claim 1 wherein the cassette is transparent.

14. The cleaning head according to claim 1 wherein the cleaning head comprises a locking mechanism for releasably locking the cassette in the cleaning head.

15. The cleaning head according to claim 14 wherein the cassette is configured to be upwardly releasable from the cleaning head away from a surface to be cleaned.

* * * * *